US005077915A

United States Patent [19]

Gross

[11] Patent Number: 5,077,915

[45] Date of Patent: Jan. 7, 1992

[54] STRESS FRACTURE REDUCTION MIDSOLE

[75] Inventor: Theodore S. Gross, Stony Brook, N.Y.

[73] Assignee: Converse, Inc., North Reading, Mass.

[21] Appl. No.: 708,088

[22] Filed: May 24, 1991

Related U.S. Application Data

[63] Continuation of Ser. No. 345,088, Apr. 28, 1989, abandoned.

[51] Int. Cl.[5] ..... A43B 13/12; A43B 13/16; A43B 13/18

[52] U.S. Cl. ..... 36/31; 36/30 R; 36/28; 36/114

[58] Field of Search ..... 36/28, 29, 30 R, 31, 36/114

[56] References Cited

U.S. PATENT DOCUMENTS

| | | | |
|---|---|---|---|
| 1,867,431 | 7/1932 | Wood . | |
| 2,366,096 | 12/1944 | Gerber | 36/71 |
| 2,404,731 | 7/1946 | Johnson | 12/146 |
| 2,468,887 | 2/1947 | Malouf | 36/71 |
| 2,486,653 | 11/1949 | Hukill | 36/71 |
| 2,613,455 | 10/1950 | Amico | 36/71 |
| 2,613,456 | 2/1950 | Amico | 36/71 |
| 2,760,281 | 8/1956 | Cosin | 36/71 |
| 3,099,267 | 7/1963 | Cherniak | 128/615 |
| 4,266,350 | 5/1981 | Laux | 36/44 |
| 4,364,188 | 12/1982 | Turner et al. | 36/31 |
| 4,402,146 | 9/1983 | Parracho et al. | 36/69 |
| 4,463,505 | 8/1984 | Duclos | 36/30 R |
| 4,615,126 | 10/1986 | Mathews | 36/30 R |
| 4,616,431 | 10/1986 | Dassler | 36/30 R |
| 4,624,061 | 11/1986 | Wezel et al. | 36/31 |
| 4,674,205 | 6/1987 | Anger | 36/30 R |
| 4,739,765 | 4/1988 | Sydor et al. | 128/615 |
| 4,768,295 | 9/1988 | Ito | 36/28 |
| 4,783,910 | 11/1988 | Boys, II et al. | 36/30 R |
| 4,794,707 | 1/1989 | Franklin | 36/30 R |

FOREIGN PATENT DOCUMENTS

| | | |
|---|---|---|
| 2458674 | 6/1975 | Fed. Rep. of Germany . |
| 2522482 | 1/1982 | France . |

OTHER PUBLICATIONS

Advertisement, "Le Coq Sportif introduces the ultimate in shock absorption," Apr. 1985.

"A Mechanical Model of Metatarsal Stress Fracture During Distance Running", Gross & Bunch, 1987.

*Primary Examiner*—Steven N. Meyers

*Attorney, Agent, or Firm*—Bromberg & Sunstein

[57] ABSTRACT

A shoe that reduces the likelihood of stress fractures occurring in the wearer's metatarsals. The shoe includes a midsole made of (i) a stress modulation layer that is made of material of relatively high duromoeter in the region of the first, fourth and fifth metatarsal, and a material of medium durmoeter in the region of the second and third durometer, and (ii) a stress moderation layer made mostly of a material of relatively low durometer.

7 Claims, 2 Drawing Sheets

STRESS FRACTURE REDUCTION MIDSOLE

This is a continuation of copending application Ser. No. 07/345,088 filed on Apr. 28, 1989, now abandoned.

TECHNICAL FIELD

The invention relates generally to shoes, and more specifically to athletic shoes of the type which reduce stress fractures to the athlete's metatarsal.

BACKGROUND OF THE INVENTION

The prior art includes several references that teach the use of padding in the soles of shoes. U.S. Pat. No. 2,468,887, issued to Malouf, teaches that a fallen metatarsal arch, which occurs when the second, third and fourth metatarsal bones are unnaturally depressed, gives rise to fatigue cramps and pain. This reference remedies the fallen metatarsal arch by inserting a cushion in the insoles or innersoles of shoes to support the second through fourth metatarsals. U.S Pat. Nos. 2,613,456 and 2,613,455, issued to Amico, also teach supporting with cushions unnaturally disposed foot bones. U.S. Pat. No. 3,099,267, issued to Cherniak, discloses a transverse support attached to the sock lining of a shoe for the purpose of supporting the metatarsal bones in shifting weight backwardly of the metatarsal heads. Several references (U.S. Pat. No. 1,867,431, issued to Wood; U.S. Pat. No. 2,366,096 issued to Gerber; U.S. Pat. No. 2,404,731, issued to Johnson; U.S. Pat. No. 2,486,653 issued to Hukill; U.S. Pat. No. 2,760,281, issued to Cosin; and U.S. Pat. No. 4,266,350 issued to Laux; and German patent document 2,458,674) disclose insoles having a top thin layer of leather and a thin bottom layer of resilient material with soft cushioning patent material placed between these two layers to form a raised cushion under the metatarsal region of the foot. U.S. Pat. No. 4,463,505, issued to Duclos, discloses an orthotic element attached to a shoe above the midsole including a raised metatarsal support that rises gradually towards the middle. U.S. Pat. No. 4,739,765, issued to Sydor et al., discloses an arch support including a removable, bendable and flexible metatarsal support inserts; metatarsal inserts of different height may be used for different activities.

U.S. Pat. No. 4,364,188, issued to Turner et al., discloses an outer sole and midsole structure designed in order to lessen the tendency of the shoe to overpronate. This reference discloses a midsole made of 35 durometer material with a forefoot cushion insert located under the metatarsal area of the foot, made of a lower durometer material (25). This reference teaches nothing with regard to lessening the likelihood of stress fractures in the metatarsals. French patent document No. 2,522,482 discloses a midsole having a first layer and forefoot and heel cushion inserts made of materials of varying hardness.

SUMMARY OF THE INVENTION

The present invention provides for a midsole that reduces the likelihood of stress fractures of the wearer's metatarsals. A midsole in accordance with the present invention includes a stress modulation layer made mostly of a flexible, resilient material of relatively high durometer and, in the region of the second and third metatarsal, made of a resilient material of medium durometer. The invention also includes a stress moderation layer disposed below the stress modulation layer and made mostly of a flexible, resilient material of relatively low durometer. In a preferred embodiment, the stress moderation layer further includes a resilient material of medium durometer in the region of the second and third metatarsal. In a further embodiment, the material of relatively high durometer is between 55 and 65 durometer Asker C-scale, the material of medium durometer is between 45 and 55 durometer Asker C-medium scale, and the material of relatively low durometer is between 34 and 45 durometer Asker C-scale.

DESCRIPTION OF SPECIFIC EMBODIMENTS

Figure 1:
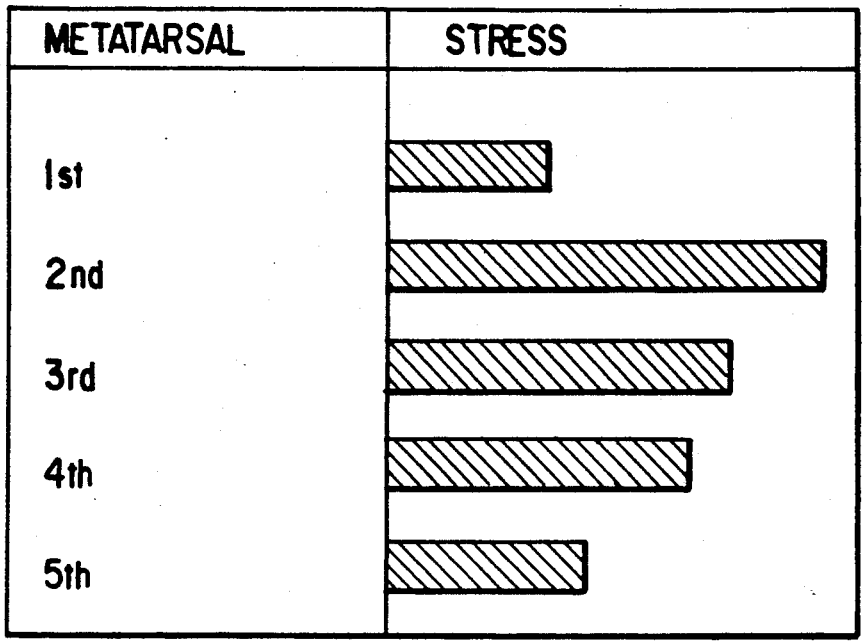
FIG. 1 is a bar chart depicting roughly the amount of stress incurred by each of the metatarsals during running without the benefit of the present invention.

Stress fractures can occur in a variety of bones, especially long slender bones such as the tibia, the fibula and the metatarsals. Which bones are most likely to incur a stress fracture depends on the type of activity. For instance, in running a majority of stress fractures are most likely to occur in the tibia. In basketball a majority of stress fractures are likely to occur to the metatarsals. (It is believed that other activities that involve being on the balls of one's feet a good deal of the time should also have a higher incidence of metatarsal stress fractures.) An analysis of the stresses that occurs in each of the metatarsals (the amount of stress which indicates the likelihood of a stress fracture) indicates that the second and third metatarsals are subjected to the most stress. FIG. 1 depicts the amount of stress incurred on each of the metatarsal heads during running. The resultant bending strain on the metatarsals is a function of the applied stress and the metatarsal geometry. The first metatarsal is subjected to less strain because of its larger size. The fifth metatarsal is subjected to less stress (and subsequently less strain) because it typically does not absorb as much impact as the lower numbered metatarsals. A detailed analysis of the stresses present in metatarsals is contained in "A Mechanical Model of Metatarsal Stress Fracture During Distance Running", coauthored by the inventor and R. P. Bunch.

The likelihood of incurring stress fractures in the metatarsals can be reduced by reducing the maximum amount of stress incurred by the metatarsals. This is accomplished by the stress modulation layer, which redistributes the shock absorbed by the metatarsals. The stress modulation layer consists of a firmer material under the first, fourth and fifth metatarsals, and a softer material under the second and third metatarsals. This layer can reduce the stress incurred by the second and third metatarsals by 20%. In order to maintain the cushioning that is taken away by the firm portion of the stress modulation layer a stress moderation layer, made of an even softer material, is disposed under the stress modulation layer. It will be appreciated that in terms of reducing stress fractures to the metatarsals, the front half of the midsole is important and the rear half of the midsole can take on a variety of embodiments.

Figure 2:
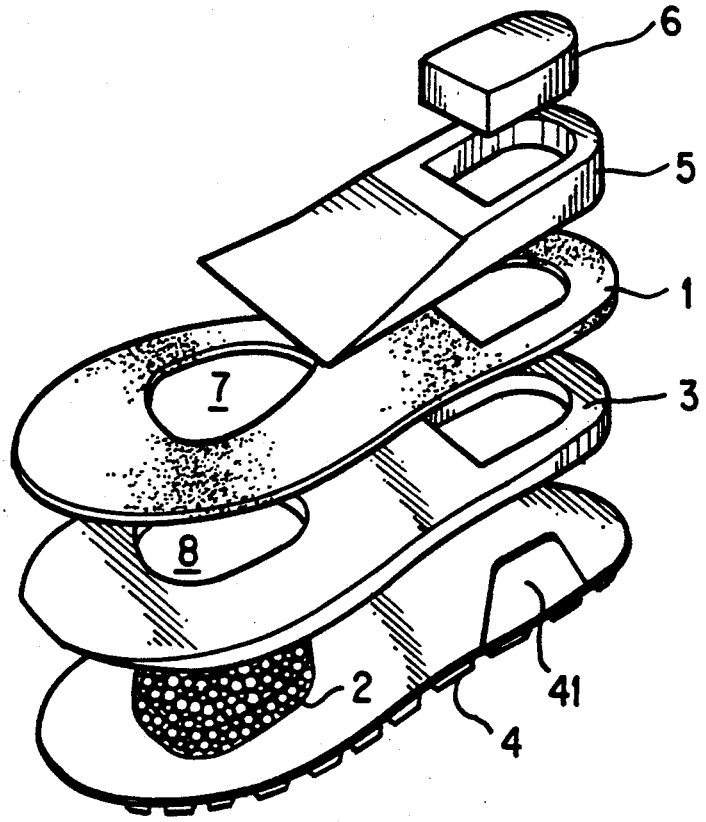
FIG. 2 is an exploded view of a preferred embodiment of the present invention.

FIG. 2 shows one embodiment of the invention. The stress modulation layer 1 includes a material of a first durometer and a cavity 7 in the region of the second and third metatarsals. A stress moderation layer 3 includes a material of a second durometer lower than the first durometer, and a cavity 8 in the region below the second and third metatarsals. As can be seen in FIG. 2, the stress modulation layer 1 is disposed, preferably affixedly attached, on top of the stress moderation layer 3. A metatarsal insert 2, made of material of a third durometer between the first and second durometer values, is contained in the cavities 7 and 8, passing through the stress modulation layer 1 and the stress moderation layer 3. It is preferable that the metatarsal insert 2 is affixedly attached to both layers, by glue for instance. It has been found to be preferable to use a value of 65 (Asker C-scale) for the first durometer, a value of 45 for the second durometer, and a value of 55 for the third durometer. Of course, these values may be varied, and the intended benefit still achieved, as long as the first durometer is the highest, the third durometer is less than the first durometer, and the second durometer is lower the than both of the first and the second durometers.

A variety of materials, including for instance polyolefinic foam, can be used for the stress modulation layer 1, the stress moderation layer 3 and the metatarsal insert 2. An outsole 4, which is made of a flexible material resistant to abrasion, is preferably affixedly attached to the bottom of the stress moderation layer 3, including the bottom of the metatarsal insert 2. The outsole 4 depicted in FIG. 2 includes heel tabs 41, which reduce the tendency of the ankle of the wearer to pronate and supinate. Such heel tabs 41 are described in U.S Pat. No. 4,402,146, issued to Crowley et al.

FIG. 2 also shows a heel structure including a wedge layer 5 and a heel plug 6. The wedge layer 5 is preferably made of a material softer than the material of the stress moderation layer 1. The heel plug 6 is preferably made of the same material (or a softer material) as the wedge layer 5. Even if the wedge layer 5 and the heel plug 6 are made of the same material, it is preferable, for manufacturing considerations, to form them separately and then attach them, preferably by glue. The heel plug 6 preferably extends through cavities in the heel areas of the wedge layer 5, the stress modulation layer 1 and the stress moderation layer 3. The difference in stiffness between the perimeter of the midsole in the heel area, which includes the wedge layer 5, the stress modulation layer and the stress moderation layer 3, and the center of the heel area of the midsole, which includes the heel plug 6—the heel plug being less stiff than the stress modulation layer 1—gives extra stability to the heel when the heel lands on the ground. As can be seen in FIG. 2, the wedge layer 5 is thickest towards the heel and begins to taper just forward of the heel down to a point near, or in, the metatarsal region.

Figure 3:
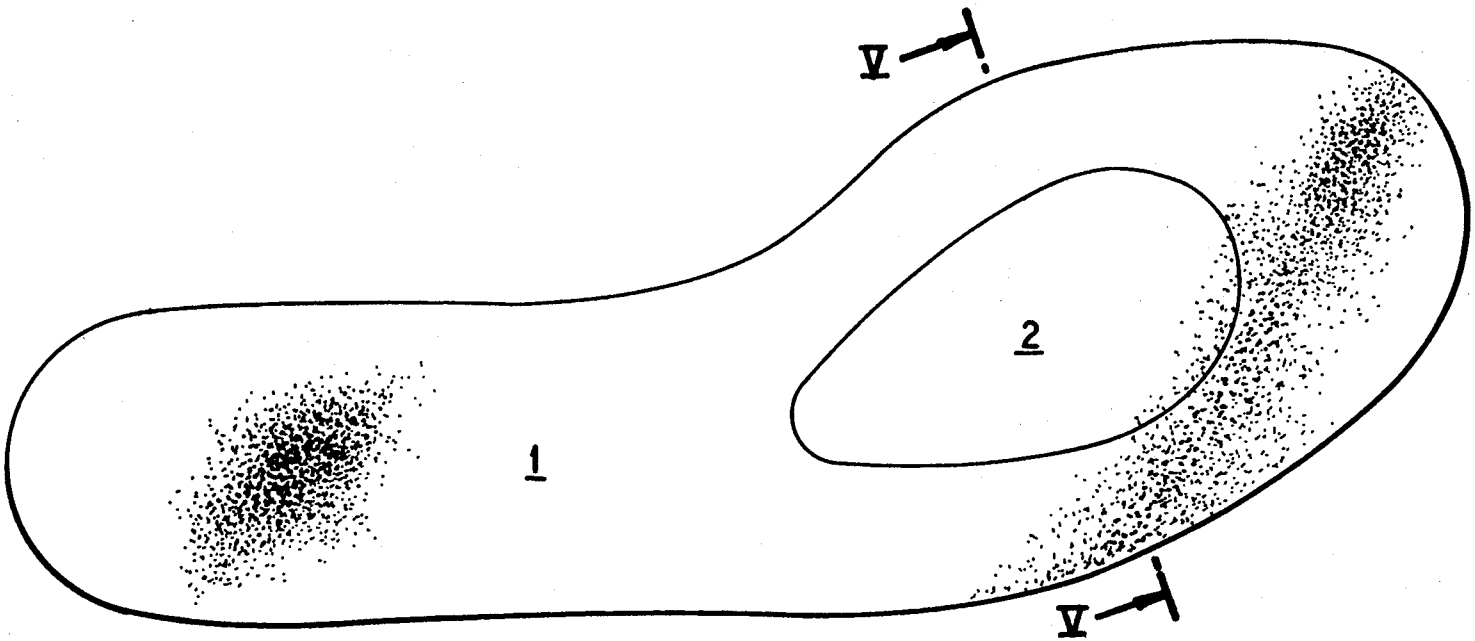
FIG. 3 is a top plan view of the stress modulation layer of the present invention.
Figure 4:
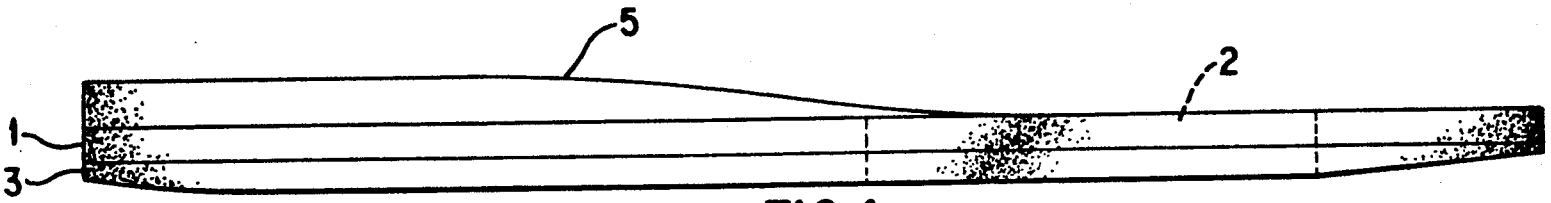
FIG. 4 is a side view of a preferred embodiment of the present invention.

FIG. 3 shows a top view of the stress modulation layer 1, including the top of the metatarsal insert 2. FIG. 4 shows a side view of a preferred embodiment of the midsole, including a wedge layer 5. The metatarsal insert 2 can be seen in phantom extending through both the stress modulation layer 1 and the stress moderation layer 3. In a preferred embodiment of the invention, the stress modulation layer 1 is about ¼" thick, and the stress moderation layer 3 is also about ¼" thick. The wedge layer 5 is about ⅜" thick at its thickest point. Of course, these dimensions will vary depending on the size of the shoe and the intended application of the shoe.

Figure 5A:
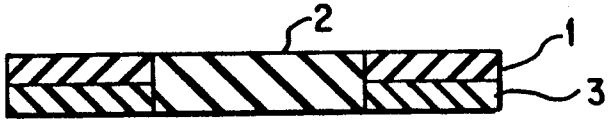
FIG. 5A is a cross section of an embodiment based on the embodiment shown in FIG. 3, taken substantially along line V—V in FIG. 3.
Figure 5B:
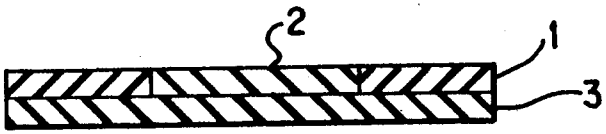
FIG. 5B is a cross section of an alternative embodiment based on the embodiment of FIG. 3, taken substantially along line V—V in FIG. 3.

FIGS. 5A and 5B depict cross-sectional views of two alternative embodiments of the invention. The cross-section is taken along line V—V in FIG. 3. FIG. 5A shows the metatarsal insert 2 extending through both layers, 1 and 3. The top half of the metatarsal insert 2 depicted in FIG. 5A can be considered part of the stress modulation layer 1, and the bottom half of metatarsal insert 2 can be considered part of the stress moderation layer 3. FIG. 5B shows an alternative, though less preferable, embodiment of the invention. In this embodiment the metatarsal insert 2 extends only through the stress modulation layer 1, and the stress moderation layer 3 is comprised of material of a single durometer.

What is claimed is:

1. A midsole for reducing the likelihood of stress fractures of a wearer's metatarsals comprising:

a stress modulation layer that, in the region of the first, fourth and fifth metatarsals, is made of a flexible resilient material of relatively high durometer and, in the region of the second and third metatarsals, is made of a resilient material of medium durometer; and a stress moderation layer disposed below the stress modulation layer and including a flexible, resilient material of relatively low durometer in the region of the first, fourth and fifth metatarsals;

wherein the stress moderation layer further includes a resilient material of medium durometer in the region of the second and third metatarsals.

2. A midsole according to claim 1, wherein the material of relatively high durometer is between 55 and 65 durometer Asker C-scale, the material of medium durometer is between 45 and 55 durometer Asker C-scale, and the material of relatively low durometer is between 35 and 45 durometer Asker C-scale.

3. A midsole according to claim 1, wherein the material of relatively high durometer is of approximately 65 durometer Asker C-scale, the material of medium durometer Asker C-scale is approximately 55 durometer Asker C-scale, and the material of relatively low durometer is approximately 45 durometer Asker C-scale.

4. A midsole according to claim 2, wherein the stress modulation layer is approximately one-quarter inch thick and the stress moderation layer is approximately one-quarter inch thick.

5. A midsole according to claim 1, further comprising a heel wedge layer disposed above the stress modulation layer in the region of the rear portion of the foot made mostly of a resilient material of medium durometer.

6. A midsole according to claim 1, wherein the stress moderation layer further includes a resilient material of medium durometer in the middle of the heel region, and the stress modulation layer further includes a resilient material of relatively low durometer along the perimeter of the heel region.

7. A midsole for reducing the likelihood of stress fractures of a wearer's selected metatarsals comprising:

a stress modulation layer that, in the region of the non-selected metatarsals, is made of a flexible resilient material of relatively high durometer and, in the region of the selected metatarsals, is made of a resilient material of medium durometer; and a stress moderation layer disposed below the stress modulation layer and including a flexible, resilient material of relatively low durometer in the region of the non-selected metatarsals and a resilient material of medium durometer in the region of the selected metatarsals;

wherein the selected metatarsals include the second metatarsal and the non-selected metatarsals include the first metatarsal.

* * * * *